US008794319B2

(12) United States Patent
Cerenzie

(10) Patent No.: US 8,794,319 B2
(45) Date of Patent: Aug. 5, 2014

(54) MULTISTAGE SEPARATOR VESSEL FOR CAPTURING LPGS

(75) Inventor: Albert Cerenzie, Red Deer (CA)

(73) Assignee: Gas Recapture Systems Ltd., Calgary, Alberta (CA)

( * ) Notice: Subject to any disclaimer, the term of this patent is extended or adjusted under 35 U.S.C. 154(b) by 75 days.

(21) Appl. No.: 13/370,497

(22) Filed: Feb. 10, 2012

(65) Prior Publication Data

US 2012/0168155 A1 Jul. 5, 2012

Related U.S. Application Data

(62) Division of application No. 13/331,575, filed on Dec. 20, 2011, now abandoned.

(60) Provisional application No. 61/462,730, filed on Feb. 2, 2011.

(30) Foreign Application Priority Data

Dec. 20, 2010 (CA) ..... 2 728 035

(51) Int. Cl.
*E21B 43/00* (2006.01)

(52) U.S. Cl.
USPC ..... 166/267; 95/258; 166/308.1

(58) Field of Classification Search
CPC . F25J 3/0209; F17C 2221/033; F17C 11/007; E21B 2043/0115
USPC ..... 166/308.1, 267; 95/258, 266; 62/617
See application file for complete search history.

(56) References Cited

U.S. PATENT DOCUMENTS

| | | | | |
|---|---|---|---|---|
| 3,846,310 | A * | 11/1974 | Blackwell et al. | 7/203 |
| 6,094,937 | A * | 8/2000 | Paurola et al. | 62/613 |
| 6,363,744 | B2 * | 4/2002 | Finn et al. | 62/621 |
| 2005/0268649 | A1 * | 12/2005 | Wilkinson et al. | 62/613 |
| 2010/0126216 | A1 * | 5/2010 | Hall et al. | 62/618 |
| 2013/0228330 | A1 * | 9/2013 | Loree et al. | 166/267 |

OTHER PUBLICATIONS

Gasfrac Energy Services LP, "LPG Vantage Frac Flow Back Guide", API V1, Jun. 2009.

* cited by examiner

*Primary Examiner* — Shane Bomar
*Assistant Examiner* — Kipp Wallace
(74) *Attorney, Agent, or Firm* — Davis & Bujold, PLLC; Michael J. Bujold

(57) ABSTRACT

A method of recovering liquid petroleum gases (LPGs) from a wellbore includes: performing a well treatment operation by injecting the LPGs into the wellbore to increase the wellbore pressure; flowing a fluid stream from the wellhead into a separation vessel, the fluid stream comprising the LPGs; reducing the pressure of the fluid stream from the wellbore pressure to a separation vessel pressure, the fluid stream in the separation vessel comprising the LPGs in liquid form and in vapour form; separating the vapour form from the liquid form; transferring the liquid form of the LPGs to a pressure vessel; and passing the vapour form through a condenser to condense the vapour form, and depositing the condensed vapour form into the pressure vessel.

20 Claims, 4 Drawing Sheets

MULTISTAGE SEPARATOR VESSEL FOR CAPTURING LPGS

FIELD

This relates to a method and apparatus for capturing LPGs using a separator vessel.

BACKGROUND

Hydrocarbon producing wells are often stimulated in order to enhance production. A fracing operation is a common method of stimulating a well. Propane is among the many types of frac fluids that may be used in the fracing operation. Propane has the advantage of being pumped into the well in liquid or gel form, and exiting the well as a gas. GasFrac Energy Services Inc. of Calgary, Alberta uses a proprietary liquefied petroleum gas in fracing operations. Other frac fluids may include propane, butane, or mixtures thereof.

SUMMARY

There is provided a method of recovering liquid petroleum gases (LPGs) from a wellbore, the wellbore having a wellbore pressure, the method comprising the steps of: performing a well treatment operation by injecting the LPGs into the wellbore to increase the wellbore pressure; flowing a fluid stream from the wellhead into a separation vessel, the fluid stream comprising the LPGs; reducing the pressure of the fluid stream from the wellbore pressure to a separation vessel pressure, the fluid stream in the separation vessel comprising the LPGs in liquid form and in vapour form; separating the vapour form from the liquid form; transferring the liquid form of the LPGs to a pressure vessel; and passing the vapour form through a condenser to condense the vapour form, and depositing the condensed vapour form into the pressure vessel.

According to another aspect, the liquid petroleum gases may comprise at least 80% propane by weight, or at least 90% propane by weight, or at least 80% butane by weight, or at least 90% butane by weight.

According to another aspect, the separation vessel pressure may be less than 500 psi, or less than 200 psi, or less than 100 psi, or less than 75 psi.

According to another aspect, the well treatment operation may be a fracturing operation.

According to another aspect, passing the vapour form through a condenser may comprise filtering the condensed liquid petroleum gases to remove entrained water and solid particles prior to condensing the vapour form.

According to another aspect, the method may further comprise the step of analyzing the composition of the fluid stream, and activating a heater to heat the fluid stream between the wellbore and the separation vessel in order to vapourize the LPGs once the LPG component of the fluid stream drops below a predetermined threshold.

According to another aspect, the method of claim 10, wherein analysing the composition of the fluid stream comprises analysing the vapour phase, the liquid phase, or both exiting the separation vessel.

According to another aspect, the method may further comprise the step of, once the heater is activated, transferring hydrocarbon liquids from the separation vessel to a production fluid facility.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
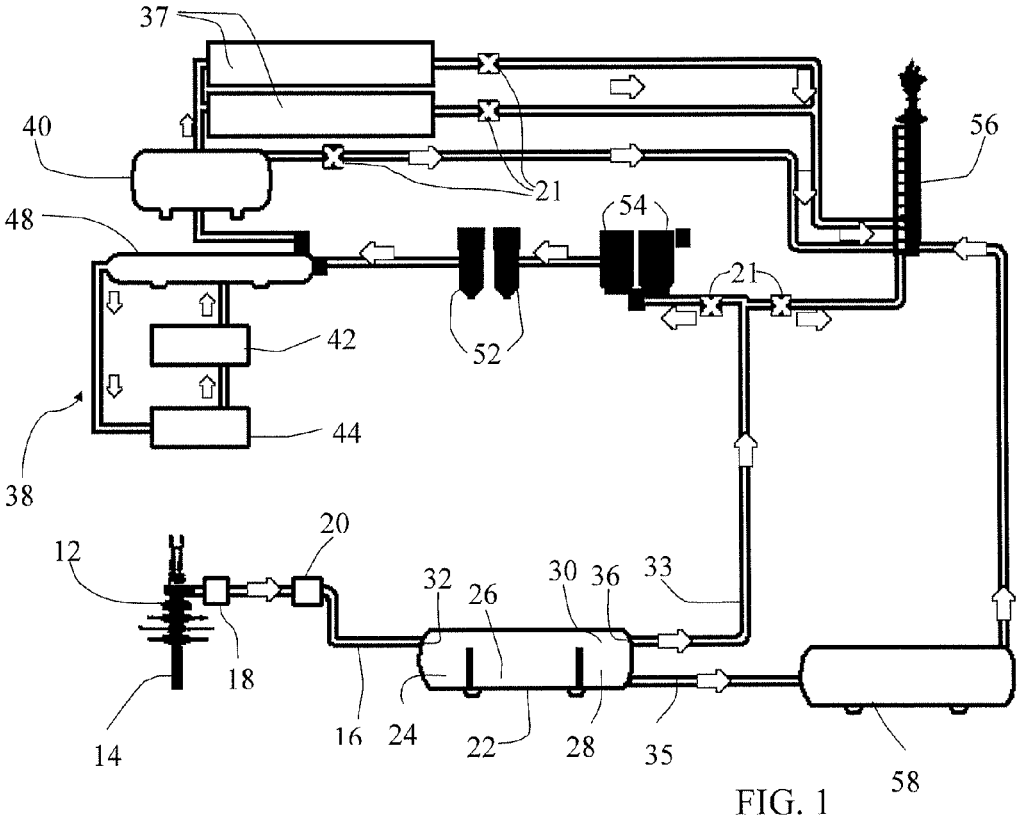
FIG. 1 is a block diagram of an arrangement for recapturing LPGs (liquid petroleum gases) pumped into a wellbore

Referring to FIG. 1, there is shown equipment that may be used in a method to capture LPGs used in a well treatment operation. During a wellbore treatment procedure, treatment fluid is pumped through a wellhead 12 into a wellbore 14. In the examples discussed below, the treatment fluid is one or more type of LPGs (liquid petroleum gases). The LPGs are pumped into the wellbore 14 to cause the wellbore pressure to reach the desired treatment pressure. Once the well treatment operation has been concluded, it is desireable to recapture as much of the LPGs as possible such that they may be reused.

LPGs are a useful treatment fluid as they tend to avoid damage to the formation, and tend to mix well with the formation fluids. In this document, LPGs are hydrocarbons or hydrocarbon mixtures whose characteristics are selected that, at standard ambient temperature and pressure, they exist as a gas, and they exist as a liquid under conditions used for the well treatment operation. For example, a hydrocarbon or hydrocarbon mixture will be considered an LPG for the purposes of this patent document if it is a gas at standard ambient temperature and pressure (SATP) but is a liquid under when used in downhole operations. Examples of LPGs include propane, propane mixtures that include 80% propane or more, or 90% propane or more by weight, mixtures of propane and butane, butane, butane mixtures that include 80% butane or more, or 90% butane or more by weight, etc. Other LPGs may include ethane, isobutene, pentaines, etc., depending on the circumstances. The most common type of well treatment operation is a hydraulic fracturing operation, where fluid is pumped under pressure to apply a pressure that is greater than the formation fracture pressure in order to stimulate the well. The formation fracture pressure is the point at which a formation will crack. The actual pressure that needs to be applied will depend on many factors, such as the depth of the zone, the water depth, the air gap, the formation pore pressure, etc. Proppant, such as sand, is pumped down with the treatment fluid in order to keep the fractures open once the pressure is released.

Once the treatment operation is complete, the pressure must be relieved by flowing back the treatment fluid. It is important that the fluid not be flowed back too quickly, otherwise the formation fractures may become clogged due to sand that flows out with the treatment fluid. Referring to FIG. 1, when flowing back a well, a fluid stream is allowed to exit wellhead 12 through line 16. As shown, the fluid stream exits wellhead 12 and passes through a pressure control device, such as a choke 18 and an emergency shut down valve (ESD) 20. Choke 18 controls the pressure and flow rate of the fluid stream. For example, choke 18 may limit the pressure to between 50 psi and 200 psi. The actual pressure may be outside this range, and will depending on the characteristics of the well (i.e. to prevent the fractures from being filled with sand) and will also depend on the pressure ratings of equipment downstream of wellhead 12. A preferred flowback pressure is between 65 psi and 100 psi, although it may be as high as allowed by the pressure vessels and the preferences of the user. ESD 20 is a safety device that will stop the fluid stream if there is a problem. As the LPGs are volatile fluids and are at high pressures, ESD 20 is an important safety feature. The system also includes a number of check valves 21 for safety reasons.

Figure 3:
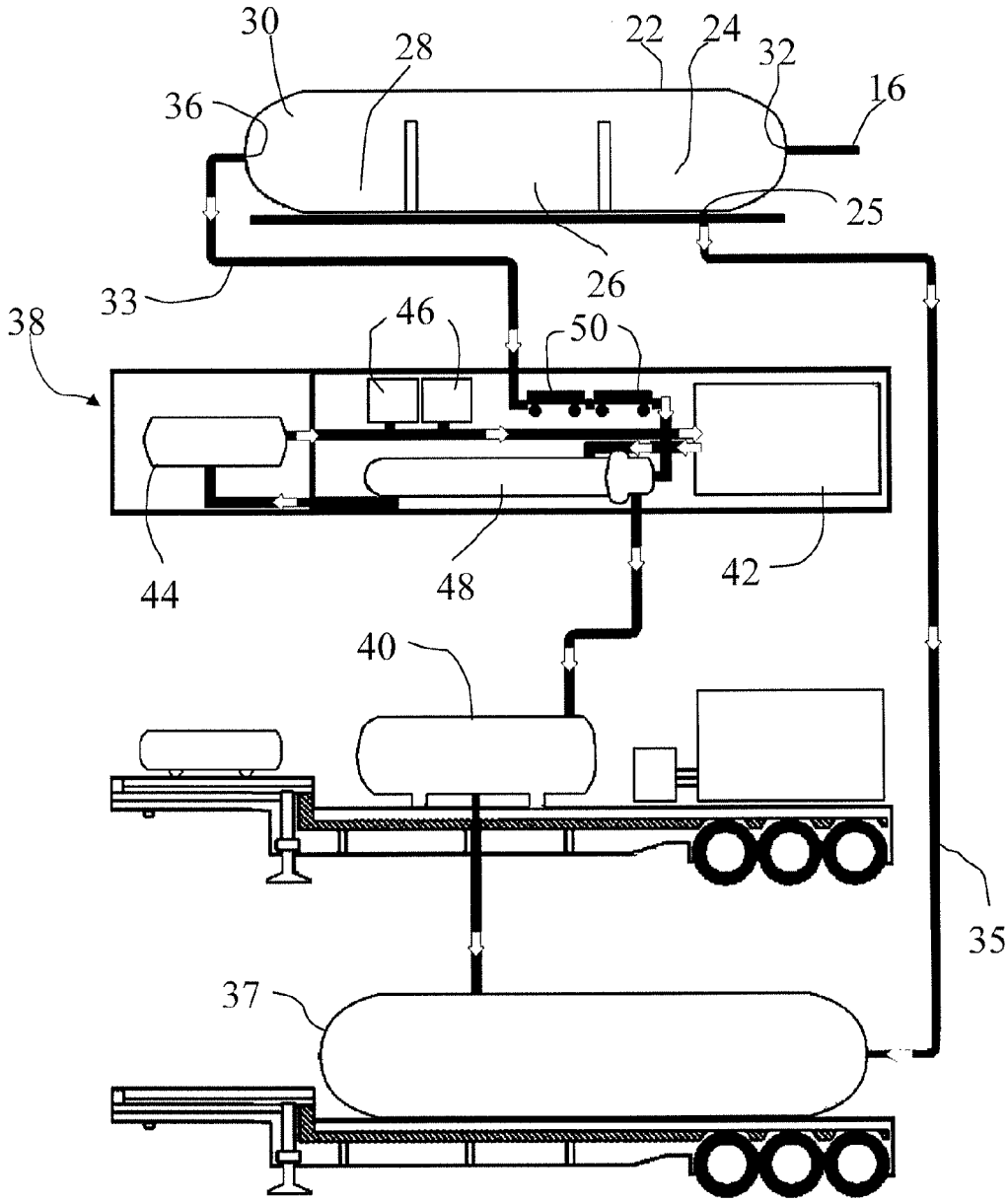
FIG. 3 is a detailed block diagram of an arrangement for recapturing LPGs.

It has been found that the fluid stream is made up primarily of the LPGs used to treat the wellbore when the well is first flowed back. This allows the user to capture LPGs as they flow from wellhead 12 in liquid form as shown in FIGS. 1 and 3, and will be described below. As more fluids are flowed out of wellhead 12, more contaminants will rise with the LPGs, making it necessary to separate the LPGs from these contaminants. While water and sand will not dissolve in the LPGs, crude oil and other hydrocarbons will dissolve in the LPGs, making it necessary to flash off the LPG's once the amount of undesireable hydrocarbons exceeds a certain threshold.

Figure 4:
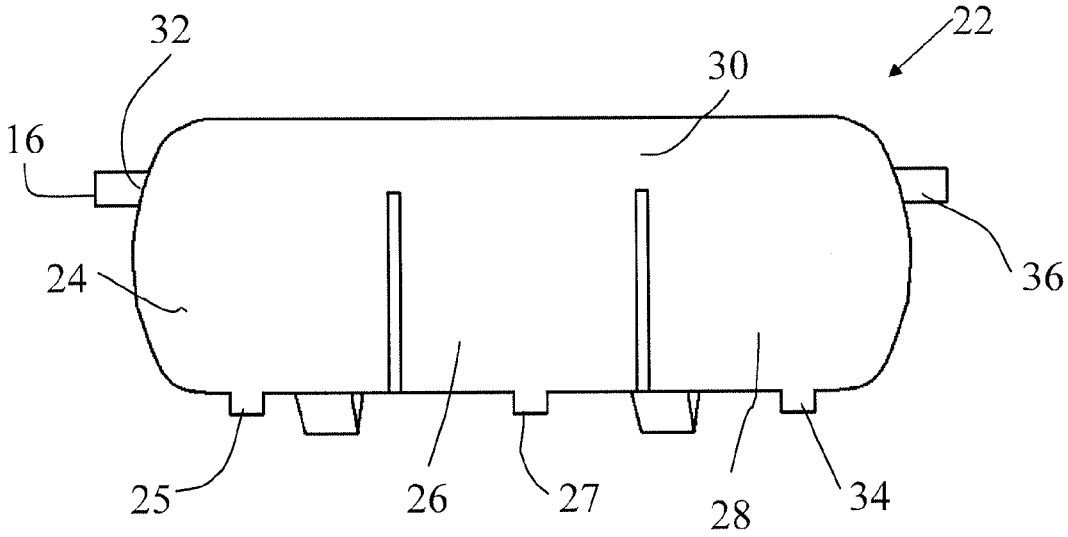
FIG. 4 is a side elevation view of a separation tank.

Referring to FIG. 3, line 16 is connected to a separation vessel 22. Referring to FIG. 4, separation vessel 22 is a pressure vessel capable of withstanding up to the desired flowback pressure, i.e. the flowback pressure and the separation vessel pressure will be equivalent. In many circumstances, a pressure rating of up to 285 psi would be sufficient, although the pressure rating may be up to 500 psi, 200 psi, 100 psi or 65 psi. As can be seen, separation vessel 22 includes a first zone 24 with a first outlet 25, a second zone 26 with a second outlet 27, a third zone 28 with a third outlet 34, and a fourth zone 30 (for vapour) with a fourth outlet 36. Separation vessel also has an inlet 32 that depicts the fluid stream into first zone 24.

Referring to FIG. 1, as mentioned above, choke 18 controls the pressure to less than 200 psi, and preferably around 100 psi or less. This represents a significant pressure drop from the pressure in wellbore 14, where the pressure will be at the wellbore treatment pressure to begin with. The pressure drop across choke 18 will cause a drop in temperature for any vapours exiting wellhead 12, such that the primary component of the fluid stream will be liquids. Referring to FIG. 3, these liquids enter separation vessel 22 via inlet 32. As depicted, separation vessel 22 is in a configuration to capture LPGs in liquid form in the fluid stream. As the fluid stream is primarily LPGs with little contaminants at the beginning, this may be done by drawing liquids out of first zone 24 through first outlet 25 and into a holding tank 37 via line 35. As there will be some LPGs in vapour state, these vapours are captured in fourth zone 30 and removed through line 33 via fourth outlet 36. These vapours pass through a condenser stage 38, through a flash tank 40 and into holding tank 37. Condenser stage 38 may include a chiller 42, a coolant holding tank 44, and coolant pumps 46 that pump coolant through a heat exchanger 48 that is used to condense the LPG vapour. There may also be some sample catchers 50 that are used to analyse the components of the gas. Referring to FIG. 1, there may also be some filters, such as aerolecent and coalescent filters 52 and 54 that remove water and dust, sand or other solid particles from the LPG vapour stream. In addition, each of these tanks is preferably connected to a flare stack 56 as a safety measure and also to flare of any vapours that are not condensed at the end of the process. It will be noted that, in FIG. 1, the liquid LPGs are placed in a different holding tank, labelled 58, than holding tank 37 as shown in FIG. 3. It will be understood that the ultimate destination of the recaptured LPGs is at the user's discretion, and may also include a pipeline or other capture/processing facility.

As noted above with reference to FIG. 3, there may be one or more sample collectors 50 that are used to analyze the composition of the LPG vapour stream through line 33. This is used to determine whether the LPG stream is sufficiently pure to continue capturing liquid LPG directly from separation vessel 22. Other analyzers may also be used, and may also be positioned in different locations, such as on line 16, line 35, or any other convenient location that will permit meaningful results. Once a certain threshold of hydrocarbon contaminants in the fluid stream is reached, the configuration of the equipment shown in FIGS. 1 and 3 is changed to heat the fluid stream in order to flash off the LPGs. The threshold will depend on the desired quality of LPGs. For example, the threshold may be at 98% LPGs by weight, 95% LPGs by weight, 90% LPGs by weight, 85% LPGs by weight, or 80% LPGs by weight, or any percentage therebetween. The desired purity will depend on how the LPGs will be processed afterward and what they are intended to be used for. A higher purity may be achieved by activating the heaters earlier.

Figure 2:
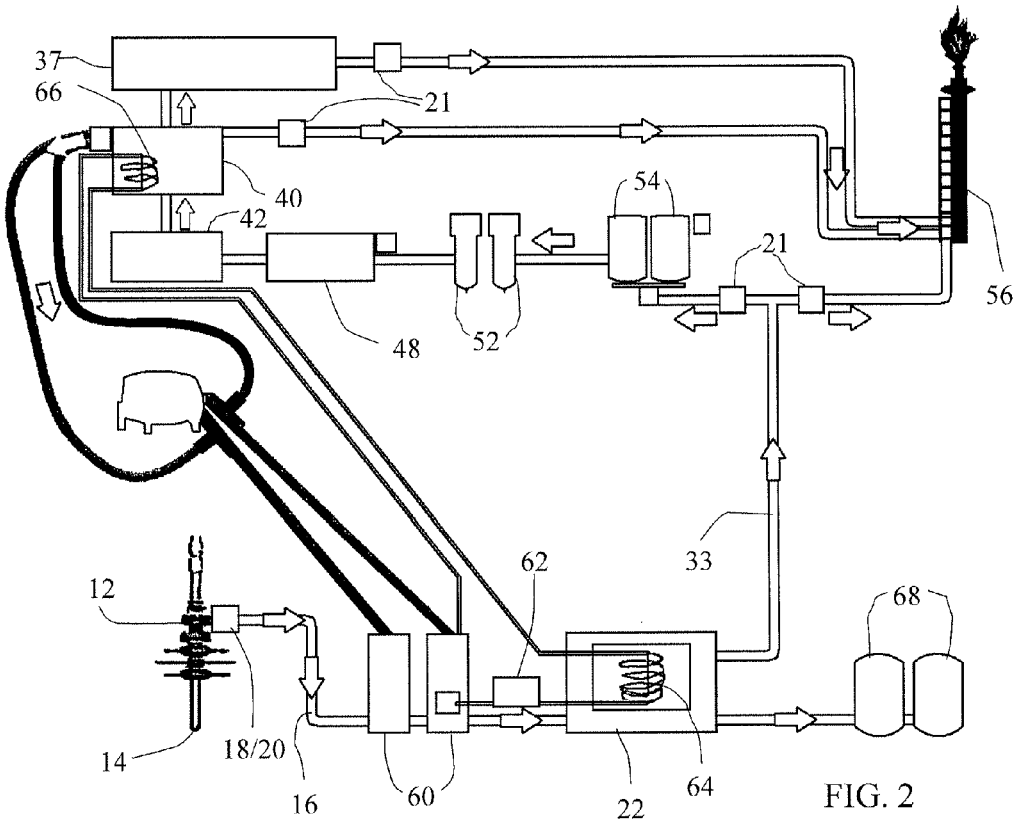
FIG. 2 is a block diagram of an arrangement for recapturing LPGs with heaters

An example of a heating strategy is shown in FIG. 2, where line heaters 60 are included. As shown, line heaters 60 are used to heat the fluid stream as it flows out of wellhead 12 in order to cause the LPGs to flash off. The heated fluid stream enters separation vessel 22. As shown in FIG. 2, line heaters 60 may be powered by LPGs that are collected from the fluid stream, and may also heat a coolant fluid that is pumped via pump 62 through a loop 64 in separation vessel 22 and also a loop 66 in flash tank 40. The capacity of line heaters 60 will depend on the heating requirements. There should be sufficient heat to cause the LPGs to flash off from the fluid stream and to prevent freezing of any components. The amount of heating may be calculated by a person of ordinary skill based on the phase change characteristics of the particular LPG being recovered, the temperature of the fluid stream before heaters 60, the pressure of the fluid stream, etc.

Once heaters 60 are in use, the operation of separation vessel 22 may change. For example, referring to FIG. 4, while liquid LPGs were previously withdrawn from first zone 24, crude oil or other liquid hydrocarbons that have not flashed may be collected in this zone 24. Alternatively, if there is a significant sand component and water component, zone 24 may be used to collect the sand, zone 26 may be used to collect the water, and zone 28 may be used to collect the crude oil, such that outlet 25 withdraws sand and other solids, second outlet 27 withdraws water and third outlet 34 withdraws oil. If there is no sand component, or no water component, zone 26 may also be used to collect the crude oil. The crude oil that is collected may be transferred to production tanks 68 as shown in FIG. 2. Throughout the process, vapour zone 30 is used to collect the LPG vapours, which are condensed using similar techniques to those discussed previously with respect to the vapour present when the liquid LPGs were recovered directly.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. The scope of the claims should not be limited by the preferred embodiments set forth in the examples, but should be given the broadest interpretation consistent with the description as a whole.

What is claimed is:

1. A method of recovering liquid petroleum gases from a wellbore, the wellbore having a wellbore pressure, the method comprising the steps of:

performing a well treatment operation by injecting the liquid petroleum gases into the wellbore to increase the wellbore pressure;

transferring a fluid stream from the wellhead into a separation vessel, such that the fluid stream entering into the separation vessel comprising primarily liquid petroleum gases in a liquid state;

reducing the pressure of the fluid stream from the wellbore pressure to a separation vessel pressure, the fluid stream in the separation vessel comprising the liquid petroleum gases in liquid form and in vapour form;

separating the liquid petroleum gases in vapour form from the liquid petroleum gases in liquid form;

transferring the liquid petroleum gases in liquid form to a pressure vessel;

passing the liquid petroleum gases in vapour form through a condenser to condense the liquid petroleum gases in vapour form into liquid form; and depositing the condensed liquid petroleum gases in vapour form into the pressure vessel.

2. The method of claim 1, wherein the liquid petroleum gases from the wellbore comprise at least 80% propane by weight.

3. The method of claim 1, wherein the liquid petroleum gases from the wellbore comprise at least 90% propane by weight.

4. The method of claim 1, wherein the liquid petroleum gases from the wellbore comprise at least 80% butane by weight.

5. The method of claim 1, wherein the separation vessel pressure is less than 500 psi.

6. The method of claim 1, wherein the separation vessel pressure is less than 200 psi.

7. The method of claim 1, wherein the separation vessel pressure is less than 100 psi.

8. The method of claim 1, wherein the separation vessel pressure is less than 75 psi.

9. The method of claim 1, wherein the well treatment operation is a fracturing operation.

10. The method of claim 1, wherein passing the liquid petroleum gases in vapour form through a condenser comprises filtering the condensed liquid petroleum gases to remove entrained water and solid particles prior to condensing the liquid petroleum gases in vapour form.

11. The method of claim 1, further comprising the step of analyzing the composition of the fluid stream, and activating a heater to heat the fluid stream between the wellbore and the separation vessel in order to vapourize the liquid petroleum gases from the wellbore once a liquid petroleum gases component of the fluid stream drops below a predetermined threshold.

12. The method of claim 11, wherein analysing the composition of the fluid stream comprises analysing a vapour phase, a liquid phase, or both exiting the separation vessel.

13. The method of claim 11, further comprising the step of, once the heater is activated, transferring hydrocarbon liquids from the separation vessel to a production fluid facility.

14. A method of recovering liquid petroleum gases from a wellbore, the wellbore having a wellbore pressure, the method comprising the steps of:

performing a well treatment operation by injecting the liquid petroleum gases into the wellbore to increase the wellbore pressure;

transferring a fluid stream, comprising the liquid petroleum gases in liquid form and in vapour form, from the wellhead into a separation vessel;

measuring a quantity of hydrocarbon contaminants contained within the fluid stream;

reducing the pressure of the fluid stream from the wellbore pressure to a separation vessel pressure prior to supplying the fluid stream to the separation vessel;

supplying the fluid stream, at the separation vessel pressure, to the separation vessel and commencing separating, during a first recovery phase within the separation vessel, the liquid petroleum gases in liquid form from the liquid petroleum gases in vapor form without heating the fluid stream;

once the measured quantity of the hydrocarbon contaminants contained within the fluid stream exceeds a predetermined threshold, initiating heating of the fluid stream, via a heater, during a second recovery phase supplying the fluid stream, at the separation vessel pressure, to the separation vessel and at least continuing to collect the liquid petroleum gases in vapor form;

transferring the liquid petroleum gases in liquid form to a pressure vessel;

passing the liquid petroleum gases in vapour form through a condenser to condense the liquid petroleum gases in vapour form into liquid form; and depositing the condensed liquid petroleum gases into the pressure vessel.

15. The method of claim 14, further comprising the steps of during the first recovery phase, drawing off primarily the liquid petroleum gases in liquid form from a first zone of the separation tank;

during the second recovery phase, drawing off at least one of sand, water, and crude oil from the first zone of the separation tank; and during both the first and the second recovery phases, drawing off the liquid petroleum gases in vapour form from a vapour zone of the separation tank.

16. The method of claim 14, further comprising the steps of, after the liquid petroleum gases in vapour form exits the separation tank, condensing substantially all of the liquid petroleum gases in vapour form into the liquid form and flaring off any remaining liquid petroleum gas in the vapour form.

17. The method of claim 14, further comprising the step of commencing the second recovery phase when a level of hydrocarbon contaminants in the fluid stream is at least 2% by weight.

18. The method of claim 1, further comprising the steps of, after the liquid petroleum gases in vapour form exits the separation tank, condensing substantially all of the liquid petroleum gases in vapour form into the liquid form and flaring off any remaining liquid petroleum gas in the vapour form.

19. The method of claim 18, further comprising the steps of:

condensing the liquid petroleum gases in vapour form by passing the vapour through a condenser stage, a flash tank, and a holding tank, and forming the condenser stage as a chiller, a coolant holding tank, and a coolant pump.

20. A method of recovering liquid petroleum gases from a wellbore, the wellbore having a wellbore pressure, the method comprising the steps of:

performing a well treatment operation by injecting the liquid petroleum gases into the wellbore to increase the wellbore pressure;

transferring a fluid stream, comprising the liquid petroleum gases in liquid form and in vapour form, from the wellhead into a separation vessel having an inlet and at least first, second, third and fourth separation zones, each separation zone having a separate outlet, and the fluid stream comprising the liquid petroleum gases;

reducing the pressure of the fluid stream from the wellbore pressure to a separation vessel pressure prior to supplying the fluid stream to the separation vessel;

separating, within the separation vessel, the liquid petroleum gases in vapour form from the liquid petroleum gases in liquid form;

during a first recovery phase, delivering the fluid stream to the separation vessel without heating the fluid stream and a majority of fluid stream being delivered to the separation vessel, during the first recovery phase, being the liquid petroleum gases in the liquid form;

commencing a second recovery phase only when a level of hydrocarbon contaminants in the fluid stream is at least 5% by weight, and only during the second recovery phase, heating the fluid stream, via a heater;

transferring the liquid petroleum gases in liquid form to a pressure vessel;

passing the liquid petroleum gases in vapour form through a condenser to condense the liquid petroleum gases in vapour form into liquid form; and depositing the condensed liquid petroleum gases into the pressure vessel.

* * * * *